United States Patent [19]

Pusey

[11] Patent Number: 4,625,954

[45] Date of Patent: Dec. 2, 1986

[54] SHEET FEEDING APPARATUS

[76] Inventor: Jon C. Pusey, 25593 Rutledge Crossing, Farmington Hills, Mich. 48018

[21] Appl. No.: 787,496

[22] Filed: Nov. 26, 1985

[51] Int. Cl.[4] ..... B65H 39/055

[52] U.S. Cl. ..... 271/9; 270/58

[58] Field of Search ..... 271/9, 109, 37, 38, 271/110, 111, 113, 117, 149, 152, 153, 154, 155; 270/58, 56

[56] References Cited

U.S. PATENT DOCUMENTS

| | | | |
|---|---|---|---|
| 2,702,189 | 2/1955 | Zugel et al. | 270/56 X |
| 3,395,913 | 8/1968 | Del Vecchio et al. | 271/64 |
| 3,830,590 | 8/1974 | Harris et al. | 355/14 |
| 3,887,176 | 6/1975 | Paulus et al. | 270/58 |
| 4,146,215 | 3/1979 | Mol | 270/58 |
| 4,323,229 | 4/1982 | Meus | 270/58 |
| 4,471,954 | 9/1984 | Bourg | 270/58 |

FOREIGN PATENT DOCUMENTS

| | | | |
|---|---|---|---|
| 1461373 | 4/1969 | Fed. Rep. of Germany | 270/56 |
| 0151564 | 9/1982 | Japan | 270/56 |
| 0156966 | 9/1982 | Japan | 270/56 |
| 0160861 | 10/1982 | Japan | 270/56 |

*Primary Examiner*—George E. A. Halvosa
*Assistant Examiner*—Lawrence J. Goffney, Jr.
*Attorney, Agent, or Firm*—Harness, Dickey & Pierce

[57] ABSTRACT

Throughput of a sheet feeding apparatus is substantially increased by sequentially feeding sheets in multiple overlapping cycles. Special start, stop and missing sheet sequences are provided to ensure that all documents in the overlapping cycles are properly assembled without missing sheets.

6 Claims, 11 Drawing Figures

SHEET FEEDING APPARATUS

BACKGROUND AND SUMMARY OF THE INVENTION

This invention relates generally to sheet feeders for automatic collating equipment. More particularly, the invention relates to an improved sheet feeder apparatus which significantly increases throughput by the multiple sequential feeding of sheets, whereby more than one sequence is carried out simultaneously.

In today's fast paced information industry there is a growing need for automatic sheet feeding equipment. Automatic sheet feeders are found in many printing machines, typesetting machines, laser printers and photocopying machines already, and use is expanding. With the recent advances in printing and photocopying technology, it is proving to be increasingly difficult to build sorting and collating equipment which can keep up with the printing or copying process. High volume printing and photocopying operations now rely heavily upon automatic sheet feaders for sorting and collating sequentially arranged sheets into books, reports, manuals, and other lengthy documents. Already the rate at which sheet feeders operate has proven to be a significant limiting factor in the speed at which collated works can be printed, copied and assembled. Accordingly, there is a continuing need to improve such sheet feeding equipment.

Traditionally, sheet feeders have operated by sequentially selecting ordered sheets or pages from sequentially arranged bins. To assemble a completed document the sheet feeder would first eject the starting page from bin 1, next the second page from bin 2, and so forth until the final page was ejected. Such a sheet feeder operated in a sequential fashion, completing one collated work before starting the next.

In an effort to improve throughput, later sheet feeders were developed which ejected all pages for one complete work simultaneously from their respective bins. The pages then traveled along respective paths of varying length, so that the first page of the work would arrive at the assembly station prior to the second page, the second page would arrive prior to the third page, and so forth. While the simultaneous feeding mechanism did improve throughput, these mechanisms were plaqued with other problems. For example, if through malfunction, a given page did not eject, then the remaining pages would nevertheless arrive at the assembly station without the missing page. Although such condition could be detected, it was not easy to insert the missing page at the proper place in the incomplete work. Thus, the incomplete work would often have to be removed from the assembly apparatus and either re-sorted back into the original feeder bins or discarded.

It is an object of the present invention to overcome the foregoing deficiencies in prior art sheet feeding mechanisms. It is a further object of the invention to provide a sheet feeding apparatus which greatly improves sheet feeding throughput without the problems encountered in the prior art. It is yet another object of the invention to provide a sheet feeding apparatus which increases throughput by sequentially feeding sheets in overlapping cycles whereby a first batch of pages is fed for assembly into a first completed document before the preceding batch of pages comprising a preceding document has been completed. It is a further object to provide a sheet feeder apparatus which may be incorporated into existing equipment to improve feeding throughput.

The invention thus provides a sheet feeder which comprises a plurality of bins for holding sheets to be fed and a sheet extracting apparatus. The sheet extracting apparatus comprises a plurality of extraction means, one of the plurality of extraction means being associated with each one of the bins, for extracting at least one sheet therefrom upon actuation. The invention further comprises a control means for establishing a sheet feed cycle and for causing the extraction of the sheets from the bins during the sheet feed cycle. The control means includes a timing means for producing a predetermined sequence of timing signals during each sheet feed cycle. A switching means is responsive to the timing means and selectively actuates selected ones of the extraction means. The timing means is configured to provide overlapping sheet feed cycles, wherein the last sheet of a first occurring sheet feed cycle is extracted from its bin after the first sheet of a second occurring sheet feed cycle is extracted.

For a more complete understanding of the invention, its objects and advantages, reference may be had to the following specification and to the accompanying drawings.

DESCRIPTION OF THE PREFERRED EMBODIMENT

Figure 1:
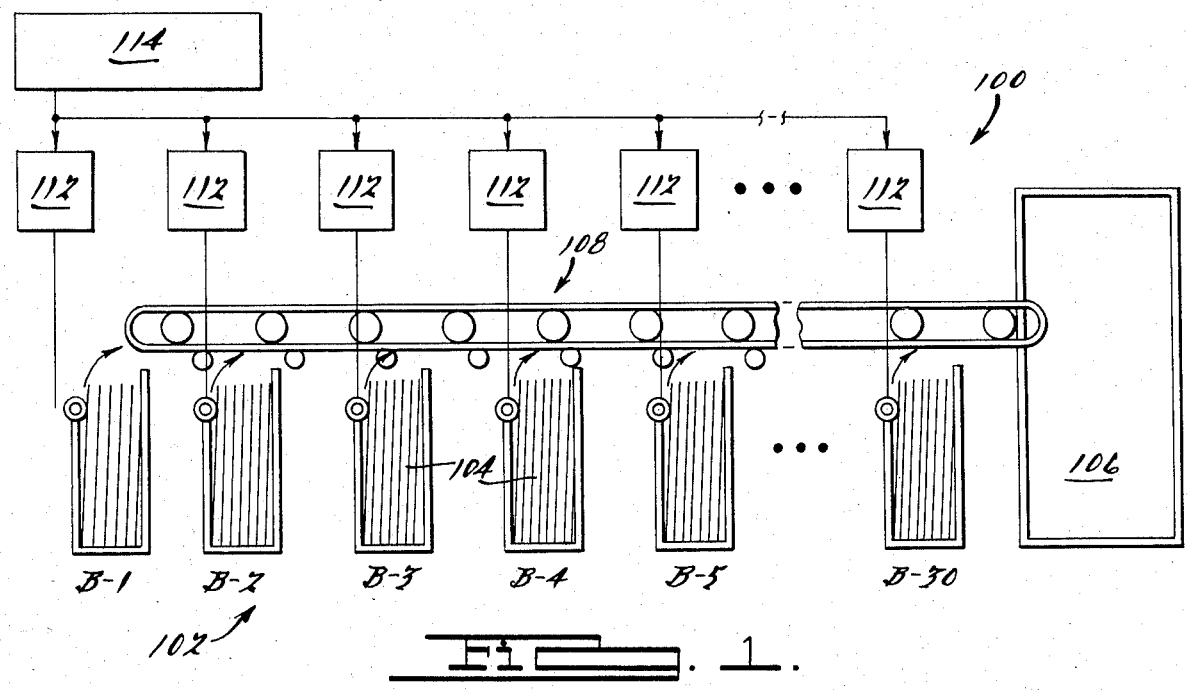
FIG. 1 is a diagrammatic representation of a collating sheet feeder with which the invention may be used.

FIG. 1 depicts a collating sheet feeding apparatus 100 which comprises a plurality of sequentially ordered bins 102 which have been assigned sequential bin numbers B-1 through B-30. Each of the bins contains a plurality of sheets 104 to be assembled into collated documents at the collection bin, assembly station or collating station 106. One sheet from each of the bins 102 make up a completed collated work. Sheets are ejected from the bins using collection mechanisms 108 and conveyor system 110 for carrying the sheets to the collection bin 106. Collection mechanisms 108 are controlled by control circuits 112 which are in turn sequentially triggered by the timing sequence control circuit 114. Timing sequence control circuit 114 is frequently implemented using a timing drum which has a plurality of raised fingers or triggers which activate microswitches in control circuits 112 in a sequential fashion.

Figure 2A:
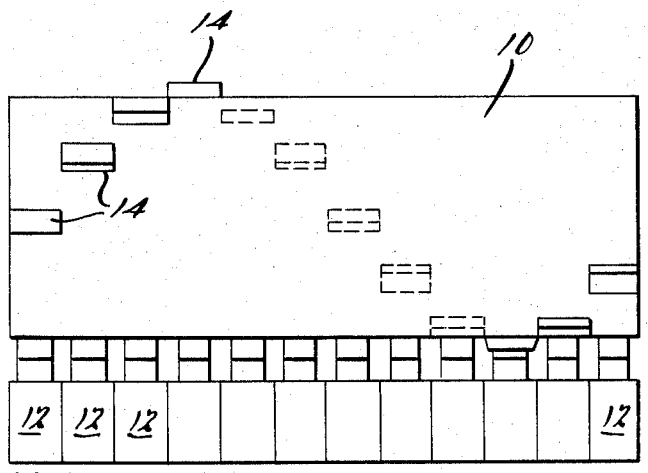
FIGS. 2A and 2B are, respectively, a diagrammatic side view and a diagrammatic end view illustrating the prior art of a conventional timing sequence drum used to produce a predetermined sequence of timing signals.
Figure 2B:
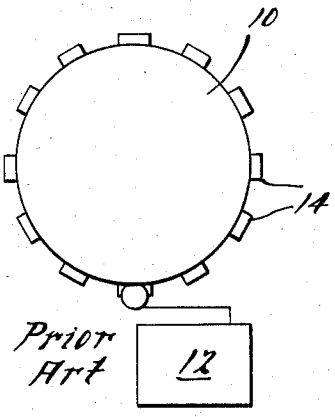
Figure 3A:
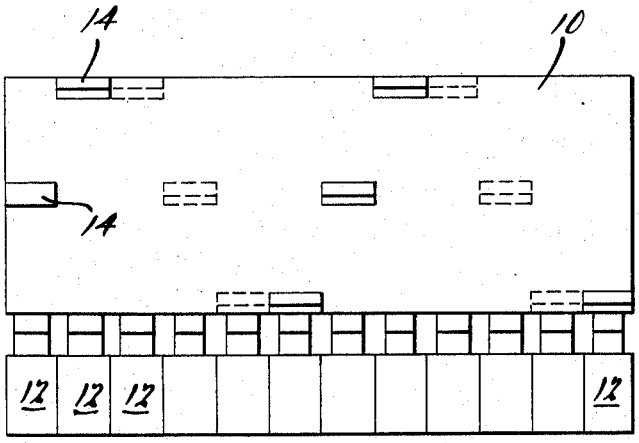
FIGS. 3A and 3B are, respectively, a diagrammatic side view and a diagrammatic end view illustrating a timing sequence drum employing the principles of the invention.
Figure 3B:
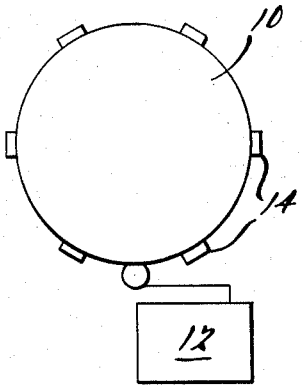

Referring now to FIGS. 2A, 2B, 3A and 3B, the prior art timing drum and the present invention's timing drum are compared to illustrate the principle by which the present invention increases throughput. FIGS. 2A, 2B, 3A and 3B illustrate timing sequence drum 10 which sequentially actuates a sequentially arranged string of microswitches 12. Timing sequence drum 10 has a plurality of raised fingers or triggers 14 which activate the microswitches when drum 10 is rotated about its axis. FIGS. 2A and 2B, a conventional timing sequence drum is illustrated wherein the triggers 14 are spirally arranged to complete one complete cycle (12 switches are shown here) in somewhat less than 360 degrees of drum rotation. FIGS. 3A and 3B illustrate an exemplary embodiment of the invention wherein the triggers 14 are spirally arranged to complete approximately 1.6 complete cycles (12 switches are shown here) in approximately 360 degrees of drum rotation. The overlapping of the feed cycles permits the inventive drum to be driven at a speed sixty percent (60%) faster than the prior art drum. Although 12 switches have been shown in FIGS. 2 and 3, it will be understood that the same principles apply if greater or fewer switches are employed. For example, if 36 switches are used to accommodate a 30-bin collator, then the prior art drum would complete one cycle (36 switches) in approximately 360 degrees of drum rotation. According to the principles of the present invention, a 36-switch (30-bin) timing sequence drum might complete 1.6 cycles as in the case described above. Alternatively, the triggers 14 might be arranged to complete more than 1.6 cycles during a given rotation. For example, using the spiral pattern of FIGS. 3A and 3B, a 36-switch drum would complete approximately 4.8 cycles per rotation. Thus, it will be seen the invention provides even greater throughput speed improvement as the number of bins increases.

Figure 4:
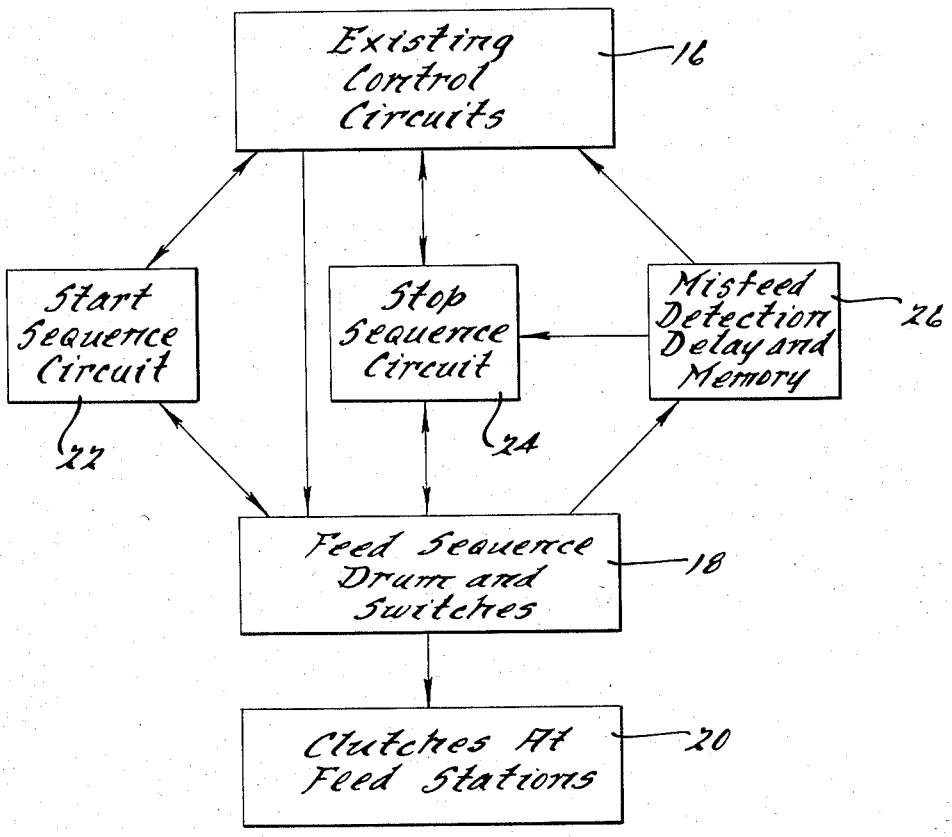
FIG. 4 is a functional block diagram of the invention.

In order to substitute the drum of FIG. 3 for the prior art drum of FIGS. 2A and 2B into existing equipment, certain other modifications to the system must be made. FIG. 4 gives an overview. FIG. 4 illustrates the existing control circuits as block 16. The feed sequence drum and switches are illustrated diagramatically at 18. The feed sequence drum and switches drive the feed station clutches denoted generally at 20. In a conventional sheet feeding apparatus the control circuits 16 would normally control the feed sequence drum and switches 18. When the improved sequence drum of FIGS. 3A and 3B is substituted for the prior art drum, certain additional circuits must be included. These circuits include a start sequence circuit 22, a stop sequence circuit 24, and a misfeed detection delay and memory circuit 26. These additional circuits are needed to handle certain special operating conditions described below.

When the sheet feeding apparatus is operating normally, more than one batch of documents is sequentially assembled at the same time. For example, with reference to FIGS. 3A and 3B, the sixth switch from the left and the twelfth switch from the left are triggered at substantially the same time, hence the sixth and twelfth pages of two different batches of assembled documents would issue from the sheet feeder at roughly the same time. This is normally the case when the invention is used to increase the throughput of the sheet feeder. A somewhat different sequence must be implemented at the start of the first batch to be assembled, since one would not normally wish to assemble a second batch beginning at page six. Similarly, a modified sequence must also be implemented at the end of the final batch to be assembled so that the sheet feeder does not commence assembly of a partially completed batch simultaneously with the final complete batch. In addition to these two naturally occurring special cases, the invention also provides for a third special case in the event a misfeed occurs during the assembly of one of the batches of documents. The manner in which these special case sequences are implemented will be described in more detail below.

Figure 5:
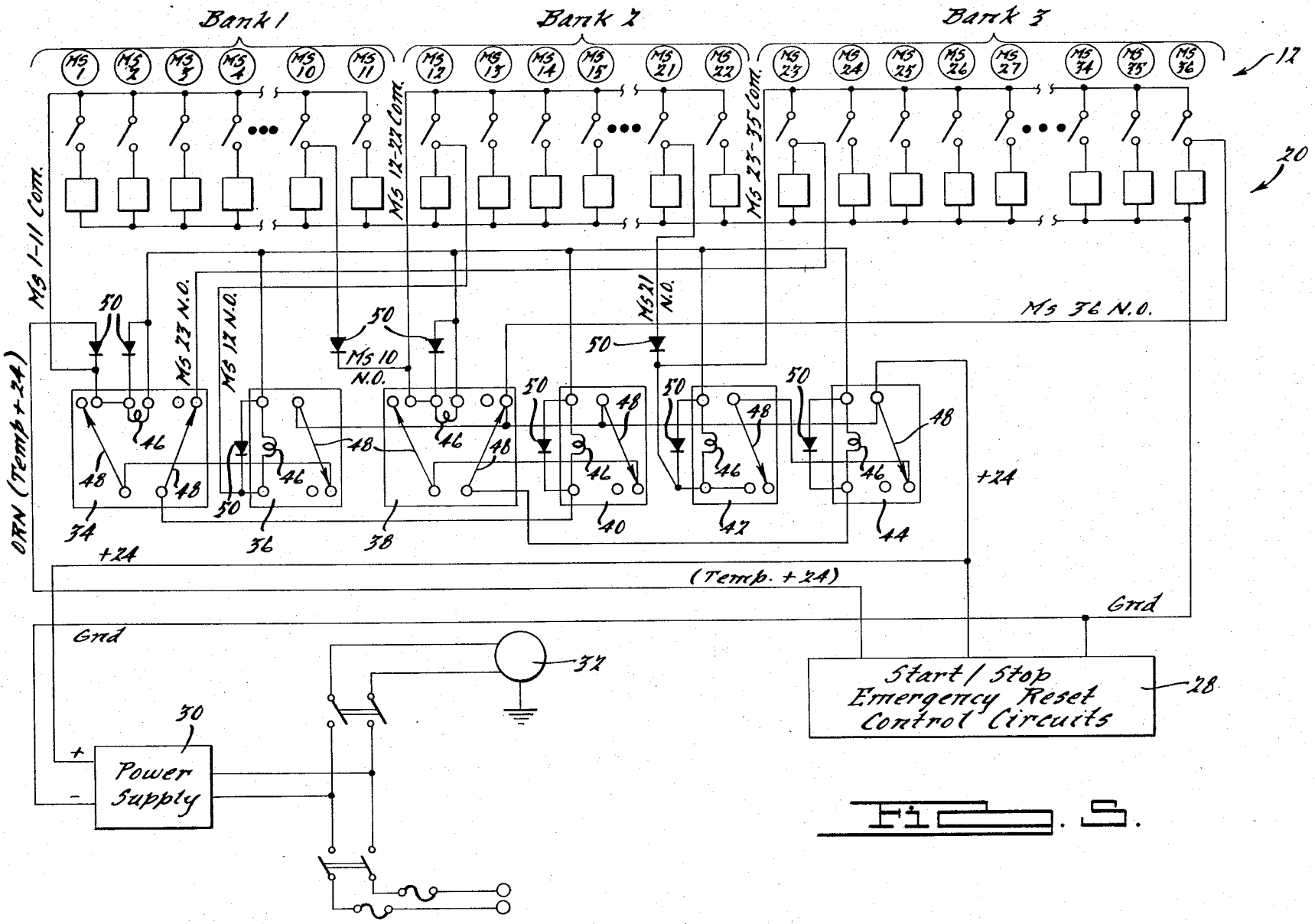
FIG. 5 is a detailed schematic circuit diagram illustrating a preferred embodiment.

Referring now to FIG. 5, the electronic circuit of the invention is illustrated in conjunction with a 30 bin (36-switch) collator apparatus. As this is a 30 bin collator, the extra six switches are used to control other machine functions in the usual fashon. As explained above, the collator circuit employs a plurality of microswitches 12. In FIG. 5, microswitches 12 have been assigned the additional numeric designations MS1 through MS36. For reasons explained below, the microswitches 12 are arranged into groups or banks. Switches MS1 through MS11 comprise bank 1, switches MS12 through MS22 comprise bank 2, and switches MS23 through MS36 comprise bank 3.

As explained above, the microswitches are triggered by the timing sequence drum (not shown) to sequentially energize the paper feed mechanisms associated with the respective bins. The feed station mechanisms are indicated generally at 20 in FIG. 5. The collator circuit also includes a conventional start/stop circuit and emergency stop circuit and a reset circuit indicated generally as control circuits 28. The control circuits are energized by a 24-volt DC power supply 30. Motive power for rotating the timing sequence drum and other moving parts within the collator apparatus is supplied by AC motor 32.

The start sequence circuit 22 and the stop sequence circuit 24 are implemented using switching devices such as relays 34, 36, 38, 40, 42, and 44. Each of the relays includes a relay coil 46 and one or more movable contacts 48. Relays 34 through 44 are coupled to the microswitches 12 as shown in FIG. 5. These relays function to apply DC power to selected banks of microswitches in a predefined order. In FIG. 5, the movable contacts are shown with all relays in the off condition, that is, before the collating apparatus is started.

Figure 6:
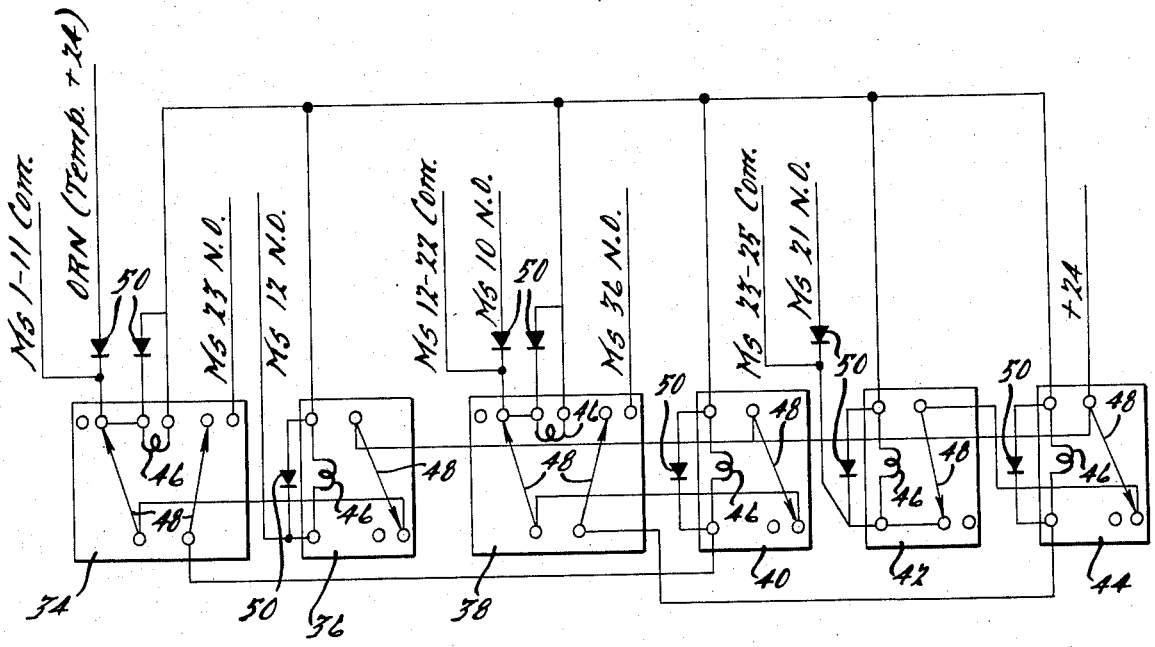
FIG. 6 is a partial schematic circuit diagram useful in explaining the operation of the invention.

FIG. 6 depicts the positions of movable contacts 48 as they appear when all relays are in the run condition after start up. It is through the banked switching arrangement provided by these relays that the invention is able to execute special start and stop sequences needed to ensure that all collated works contain the correct number and sequence of pages. As indicated in FIGS. 5 and 6, the circuit of the invention also includes a plurality of diodes 50 which are needed to direct current flow as will be described below. In general, relays 34 through 44, together with diodes 50, comprise a logic circuit whereby the special start and stop sequences are performed. While the present invention is disclosed in conjunction with an electromechanical sequence drum and microswitch arrangement, the principles of the invention may be applied in solid-state digital and microprocessor controlled circuits as well. One benefit of the presently preferred embodiment described herein is that it can be incorporated into existing electromechanical equipment without major design changes and tooling changes.

Figure 9:
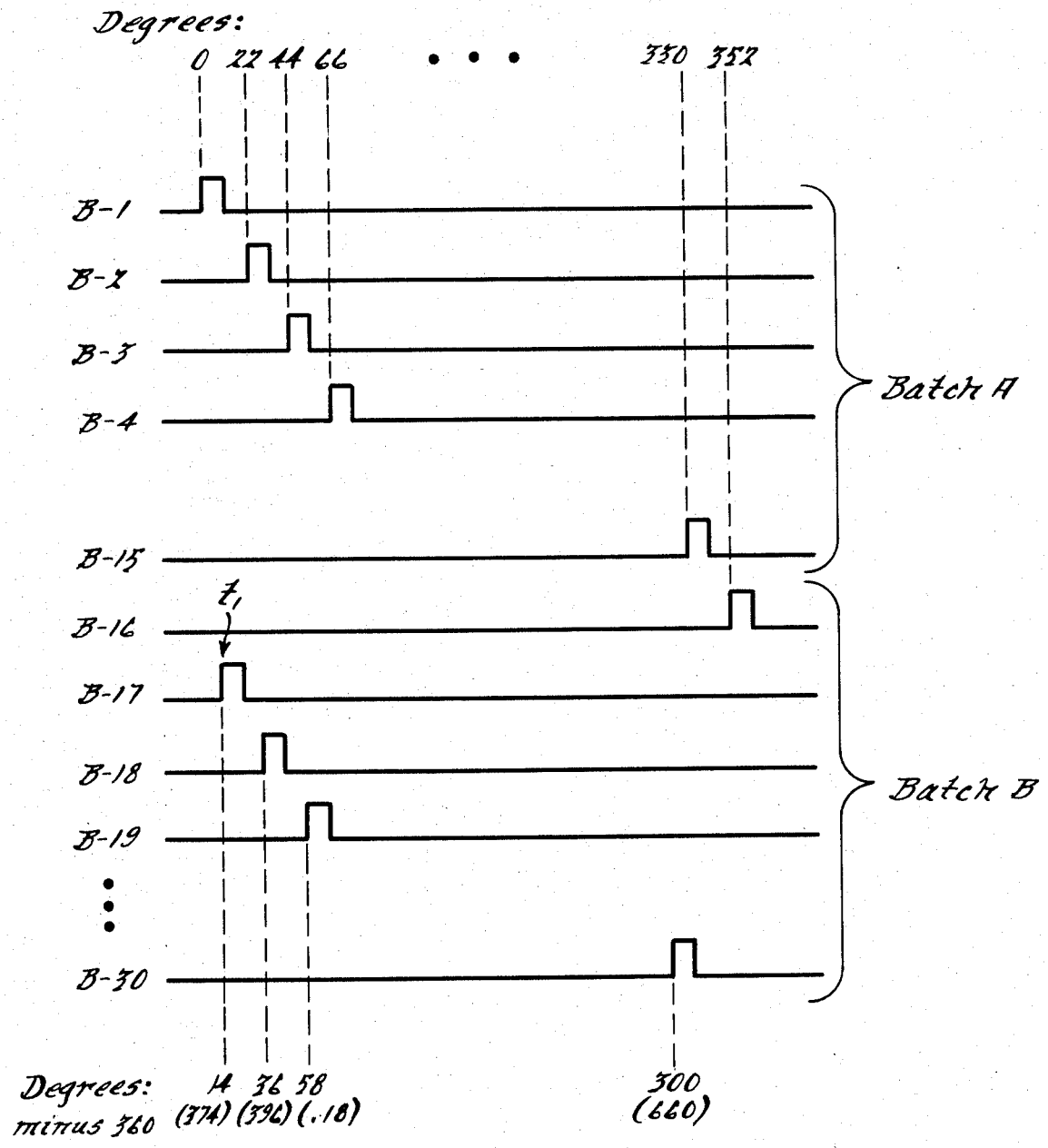
FIG. 9 is a timing diagram useful in understanding the principles of the invention in operation.

In operation, the timing sequence drum 10 is driven about its axis causing triggers 14 to sequentially trip microswitches 12. As each microswitch is tripped, the corresponding feed station clutch mechanism 20 is energized, causing a sheet from the corresponding bin to be fed to the collating station. Setting aside for the moment the start and stop sequences, the normal operating sequence using the multiple spiral drum 10 of FIGS. 3A and 3B is such that more than one sequence is carried out simultaneously. In other words, more than one collated document is assembled at one time. FIG. 9 illustrates this. FIG. 9 is a timing sequence diagram illustrating the manner in which microswitches 12 are triggered as timing sequence drum 10 rotates. The trigger pulses may be conceptually viewed as sheets issuing from the corresponding bins denoted in FIG. 9. The flow of sheets may be conceptualized as two waves of sheets, one for a first collated batch A and the other for a second collated batch B. Depending on the spiral configuration of drum 10, additional waves of documents representing additional collated batches to be assembled may also issue from the sheet feeder during the same drum rotation interval. Two waves are illustrated in FIG. 9 to correspond to the timing sequence drum of FIGS. 3A and 3B.

With continued reference to FIG. 9, it will be appreciated that during the start up sequence only one collated batch may be initially assembled. It is not until the first batch reaches the page shown at time $t_1$ that the first page of the next batch should issue. A similar situation occurs during the shutdown sequence, since the first few sheets of the next normally occurring batch must be suppressed. Relays 34 through 44 provide the appropriate suppression through a banked switching technique.

Referring to FIG. 5, the felays 34 through 44 are shown in the off condition which is assumed prior to start up. Relay coil 46 of relay 34 is energized when the start up sequence is commenced by control circuit 28 applying a positive potential on the TEMP+24 lead. The voltage on the TEMP+24 lead also energizes the MS1−11 COM lead, thereby activating bank 1 (switches MS1 through MS11). Due to the operation of relays 34 through 44, banks 2 and 3 are deactivated, so that all triggering signals issuing from microswitches MS12 through MS36 are ignored. In this fashion, the start sequence begins by issuing only one sheet at a time.

Once drum 10 has advanced to the point where switch MS10 is closed, coil 46 of relay 38 is energized causing bank 2 to be energized. Later, after microswitch MS21 is closed, relay 42 is energized, causing bank 3 to be energized. At this point, all three banks are energized and the normal operation proceeds. FIG. 6 illustrates the positions of movable contacts 48 of relays 34 through 44 once the start up sequence is completed and the normal run condition is in effect.

The shutdown sequence occurs in much the same way. Control circuit 28 initiates the shutdown sequence by removing the voltage signal on line TEMP+24. Referring to FIG. 6, relay 34 remains energized after the voltage on line TEMP+24 if removed, until switch MS12 is triggered. Banks 2 and 3 remain energized until switch MS23 is triggered, whereupon bank 2 is de-energized. Finally, when microswitch MS36 is triggered, bank 3 is de-energized and the stop sequence is completed.

Figure 7:
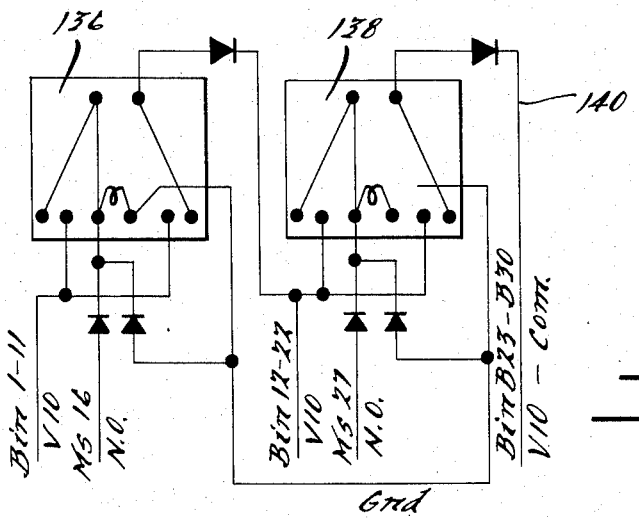
FIG. 7 is a partial schematic circuit illustrating the missing sheet signal processing circuit of the invention.
Figure 8:
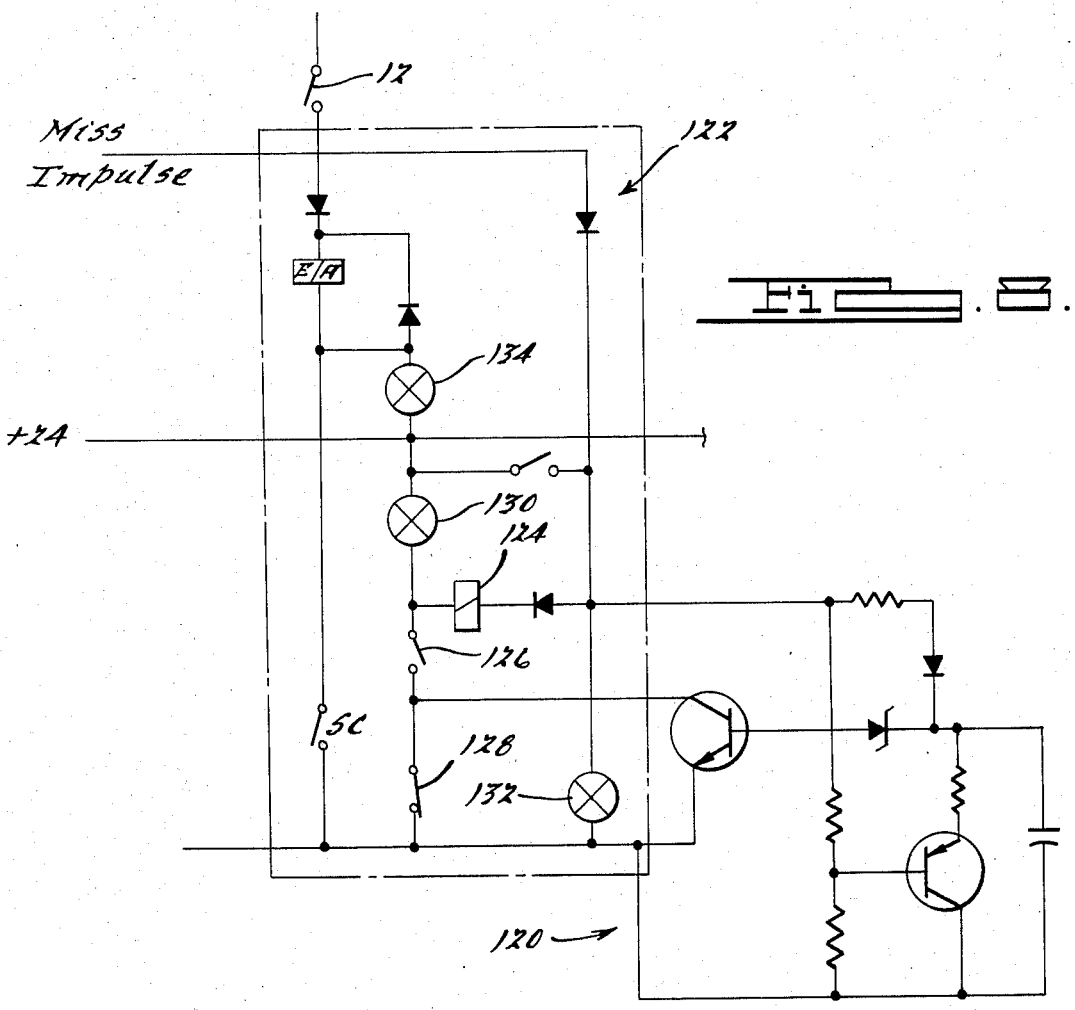
FIG. 8 is a schematic circuit diagram depicting the presently preferred misdetection circuit of the invention.

FIG. 7 illustrates the missing sheet signal delay apparatus of the invention. This circuit is needed to condition the missing sheet detection circuits so that missing sheet signals are not erroneously reset or cancelled before they can be responded to. FIG. 8 illustrates the presently preferred electronic delay circuit used in the misfeed detection circuitry.

With conventional collators, a missing sheet switch or sensor is activated by the successful feeding of the immediately proceeding sheet. Once the sensor is activated, the next sequential sheet must feed and be detected within a predetermined time, otherwise a missing sheet event is declared. Typically the missing sheet event is signaled by lighting a numbered warning lamp so that the operator may correct the situation. In other words, the missing sheet detection circuit assumes a missing sheet condition until the next sheet trips the sensor and cancels the missing sheet event. When two or more separate batches are being sequentially run at the same time using the present invention, the missing detection circuitry must be modified so that missing sheet events are not erroneously reset by an active sheet detection sensor elsewhere in the sequence. FIG. 8 depicts the delay circuitry 120 which is needed to prevent the improper reseting of misfeed events. A delay circuit 120 is required for each of the clutch mechanisms 20 associated with bins B-1 through B-30. FIG. 8 illustrates the conventional misfeed circuitry generally at 122. As indicated, misfeed circuitry 122 is coupled to microswitch 12. FIG. 8 illustrates the circuitry associated with microswitch MS1 and it will be understood that similary circuitry will be used with the remaining microswitches 12.

The misfeed circuitry 122 includes a missing sheet detection and control circuit 124 in the form of a relay having a misselection and cancel switch 126 and a missing sheet microswitch or sensor 128. A green indicator lamp 130 is used to serve as a misselection pilot light, a red lamp 130 is used as a missing sheet warning light, and an amber lamp 134 is used as the bin selection pilot light. During normal operation, the sensor 28 breaks the misdetection circuit (cancelling the misdetection event) when the next sheet is properly fed and detected. The delay circuit 120 shunts across sensor 128 and operates to prevent the sensor 128 from cancelling the misdetection event until a predetermined time has elapsed from the energizing of the relay 124. In this manner, the missing sheet lamp 132 for a particular bin remains lit even if the subsequent batch documents is not missing that particular sheet. This permits the operator to identify and supply the missing sheet as required.

In addition to ensuring that the missing sheet lamps remain lit, it is also desirable to permit the sheet feeding process to continue until the sequence which initiated the missing sheet event and the sequence which follows to both run to completion. A conventional sheet feeding circuit simply detects a missing sheet event and halts the sheet feeding cycle when the end of that cycle is reached. To ensure that all sequences in progress are completed, the present invention employs the missing sheet signal delay circuit of FIG. 7. The circuit of FIG. 7 is coupled to each of the missing sheet control circuits 124 and operates to suppress the missing sheet logic signal to the shutdown circuit until all partially completed cycles having finished. The circuit of FIG. 7 comprises relays 136 and 138. Relay 136 is responsive to missing sheet signals from bins B-1 through B-11, while relay 138 is responsive to bins B-12 through B-22. In effect, relays 136 and 138 operate in a sequential fashion. Relay 136 is energized and latched in response to the momentary closing of microswitch MS16. Relay 138 is similarly responsive to the momentary closing of microswitch MS27. Only after relays 136 and 138 have both latched will the missing sheet signal be issued on missing sheet logic lead 140 to the conventional shutdown circuit.

The missing sheet signal delay circuit of FIG. 7 thus allows all partially completed batches to reach completion before the shutdown occurs. Assuming the timing sequence drum is configured to run two batches simultaneously, then the equipment operator must only check the last two collated batches for missing sheets in accordance with the red indicator lamps 132.

While the invention has been illustrated and described in its presently preferred embodiment, it will be understood that the invention is capable of modification and change without departing from the scope of the invention in its broader aspects. The invention may, for example, be implemented using equivalent electronic logic circuits or microprocessor circuits for implementing multiple sequential operation of the invention.

What is claimed as novel is as follows:

1. A sheet feeder comprising:

a plurality of bins for holding sheets to be fed;

a plurality of extraction means, one of said plurality of extraction means being associated with each one of said bins for extracting at least one sheet therefrom upon actuation; and control means for establishing a sheet feed cycle and for causing the extraction of said sheets from said bins during said sheet feed cycle, said control means including:

timing means for producing a predetermined sequence of timing signals during each sheet feed cycle, said timing means being configured to provide overlapping sheet feed cycles wherein the last sheet of a first occurring sheet feed cycle is extracted after the first sheet of a second occurring sheet feed cycle is extracted;

switching means responsive to said timing means for selectively actuating selected ones of said extraction means;

missing sheet detection means for providing a missing sheet warning signal upon activation, said detection means being activated upon the occurrence of a timing signal associated with the extraction of a first sheet and being deactivated upon the extraction of a second sheet sequentially after said first sheet; and means for synchronizing said detection means with said overlapping sheet feed cycles including means for preventing the activation of said detection means in response to the next occurring timing signal associated with the extraction of said first sheet.

2. The sheet feeder of claim 1 further comprising means for defining a start up sheet feed cycle and means for sequentially energizing said switching means during said start up cycle.

3. The sheet feeder of claim 1 further comprising means for defining a shut down sheet feed cycle and means for sequentially de-energizing said switching means during said shut down cycle.

4. The sheet feeder of claim 1 wherein said synchronizing means comprises latching means for preventing the activation of said detection means for a predetermined time.

5. The sheet feeder of claim 1 wherein said timing means includes a drum having a plurality of fingers and further includes a plurality of switches responsive to said fingers to provide timing signals for controlling said feed cycles.

6. The sheet feeder of claim 5 wherein said drum includes rotation means and wherein said fingers are spirally arranged around said drum to complete one complete feed cycle in less than three hundred sixty degrees of drum rotation.

* * * * *

UNITED STATES PATENT AND TRADEMARK OFFICE

CERTIFICATE OF CORRECTION

PATENT NO. : 4,625,954

DATED : December 2, 1986

INVENTOR(S) : Jon C. Pusey

It is certified that error appears in the above-identified patent and that said Letters Patent is hereby corrected as shown below:

Column 1, line 47, "plaqued" should be --plagued--.

Column 3, line 12, before "FIGS. 2A and 2B," insert --In--.

Column 3, line 44, "diagramatically" should be --diagrammatically--.

Column 4, line 16, "fashon" should be --fashion--.

Column 5, line 36, "felays" should be --relays--.

Column 5, line 61, "if" should be --is--.

Column 6, line 30, "similary" should be --similar--.

Column 6, line 63, "having" should be --have--.

Signed and Sealed this

Fourteenth Day of April, 1987

*Attest:*

DONALD J. QUIGG

*Attesting Officer*

*Commissioner of Patents and Trademarks*